United States Patent [19]

Redding et al.

[11] Patent Number: 4,640,602

[45] Date of Patent: Feb. 3, 1987

[54] SHEET FEEDER-STACKER

[75] Inventors: Thomas P. Redding, Penfield; Laurence S. Barker, Fairport, both of N.Y.

[73] Assignee: Xerox Corporation, Stamford, Conn.

[21] Appl. No.: 624,439

[22] Filed: Jun. 25, 1984

[51] Int. Cl.[4] ..... G03G 15/00; G03G 21/00

[52] U.S. Cl. ..... 355/3 SH; 271/162

[58] Field of Search ..... 355/3 R, 3 SH, 14 SH; 271/94, 98, 157, 162, 163, 164

[56] References Cited

U.S. PATENT DOCUMENTS

| | | | |
|---|---|---|---|
| 3,827,687 | 8/1974 | Kono | 271/162 X |
| 3,947,018 | 3/1976 | Stange | 271/99 |
| 4,219,192 | 8/1980 | Burke | 271/164 X |
| 4,375,285 | 3/1983 | Dennhardt | 271/162 X |
| 4,397,459 | 8/1983 | Silverberg et al. | 271/94 |
| 4,504,053 | 3/1985 | Shiozawa | 271/157 X |

FOREIGN PATENT DOCUMENTS

| | | | |
|---|---|---|---|
| 57-180537 | 11/1982 | Japan | 271/162 |

*Primary Examiner*—Fred L. Braun

*Attorney, Agent, or Firm*—H. Fleischer; J. E. Beck; R. Zibelli

[57] ABSTRACT

An apparatus in which successive flexible sheets are advanced from a stack. The stack of sheets are held in a substantially vertical orientation. Successive outermost sheets from one side of the stack are fed, in seriatim in a direction substantially opposed to the direction of the gravitational force exerted thereon. The stack of sheets is moved toward a sheet feeder so as to position successive outermost sheets of one side thereof in a feeding relationship therewith. In addition, the stack holder moves from an operative position, in which the sheets are in a sheet feeding relationship, to an inoperative position for loading a new stack therein.

5 Claims, 7 Drawing Figures

SHEET FEEDER-STACKER

This invention relates generally to an electrophotographic printing machine and more particularly concerns an apparatus for advancing successive flexible sheets from a stack thereof.

In the process of electrophotographic printing, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon the irradiated areas. This records an electrostatic latent image on the photoconductive member corresponding to the imformational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In a commercial printing machine of the foregoing type, the copy sheets are stacked on a horizontal tray. The tray moves in a vertical direction. An elevator system is employed to automatically advance the tray in an upward vertical direction so as to position successive uppermost sheets in contact with the sheet feeder. When the supply of copy sheets in the tray is below a pre-selected level, the printing machine is automatically de-energized, and the elevator moves the tray downwardly to an inoperative position for loading a new stack of copy sheets therein. A system of this type is fairly complex and limits the printing machine configurations. It is desirable to simplify the copy sheet stacking and feeding system and to eliminate the elevator system associated therewith. Various approaches have been devised for sheet feeding. The following disclosures appear to be relevant:

U.S. Pat. No. 3,615,129; Patentee: Drawe et al.; Issued: Oct. 26, 1971;

U.S. Pat. No. 3,937,455; Patentee: Hauser; Issued: Feb. 10, 1976;

U.S. Pat. No. 3,947,018; Patentee: Stange; Issued: Mar. 30, 1976;

U.S. Pat. No. 4,348,019; Patentee: Stievenart et al.; Issued: Sept. 7, 1982.

The pertinent portions of the foregoing disclosures may be briefly summarized as follows:

Drawe et al. discloses a duplex tray for receiving copy sheets having a fused toner image on one surface thereof. After the requisite number of copy sheets are received in the duplex tray, a sheet feeder sequentially feeds these sheets through the printing process for creating images on the opposite side thereof.

Hauser describes a sheet feeder having a vertically oriented hopper storing a stack of sheets therein. Rollers are positioned at the bottom of the hopper to engage successive sheets and advance them downwardly to a scanner of a facsimile scanner.

Stange discloses a sheet feeder having a vacuum transport for advancing successive bottom sheets from a stack of sheets. An air cushion is formed between the bottom sheet and the plate adjacent thereto, and between the bottom edge of the sheets and the bottom edge guide. A follow up plate engages the top sheet of the stack and applies a slight downward force on the stack.

Stievenart et al. describes a stack of vertically oriented sheets positioned in a magazine with the bottom end of the magazine being open. A pair of feed rollers advance successive sheets downwardly from the magazine through the open end thereof.

In accordance with one aspect of the features of the present invention, there is provided an apparatus for advancing successive flexible sheets from a stack thereof. Means are provided for holding the stack of sheets in a substantially vertical orientation. Means feed successive outermost sheets from one side of the stack in the holding means in a substantially vertically direction opposed to the direction of the gravitational force exterted thereon. Means, engaging the outermost sheet of the other side of the stack in the holding means, move the stack toward the feeding means so as to position successive outermost sheets of the stack in a feeding relationship therewith. The holding means is arranged to move from an opeative location in which ssuccessive outermost sheets are in a sheet feeding position to an inoperative position for loading sheets therein.

Pursuant to another aspect of the present invention, there is provided an electrophotographic printing machine of the type having a toner image formed on a photoconductive belt wherein successive flexible sheets advance to a transfer station for receiving toner images thereat. Means are provided for holding a stack of sheets in a substantially vertical orientation. Means feed successive outermost sheets from one side of the stack in the holding means in a substantially vertical direction opposed to the direction of the gravitational force exerted thereon. Means, arranged to receive successive sheets from the feeding means, transport the sheets to the transfer station for receiving the toner image thereat. Means, engaging the outermost sheet of the other side of the stack in the holding means, move the stack toward the feeding means so as to position successive outermost sheets in feeding relationship therewith. The holding means is arranged to move from an operative location in which successive outermost sheets are in a sheet feeding position to an inoperative position for loading sheets therein.

Other aspects of the invention will become apparent as the following discription proceeds and upon reference to the drawings, in which.

Figure 1:
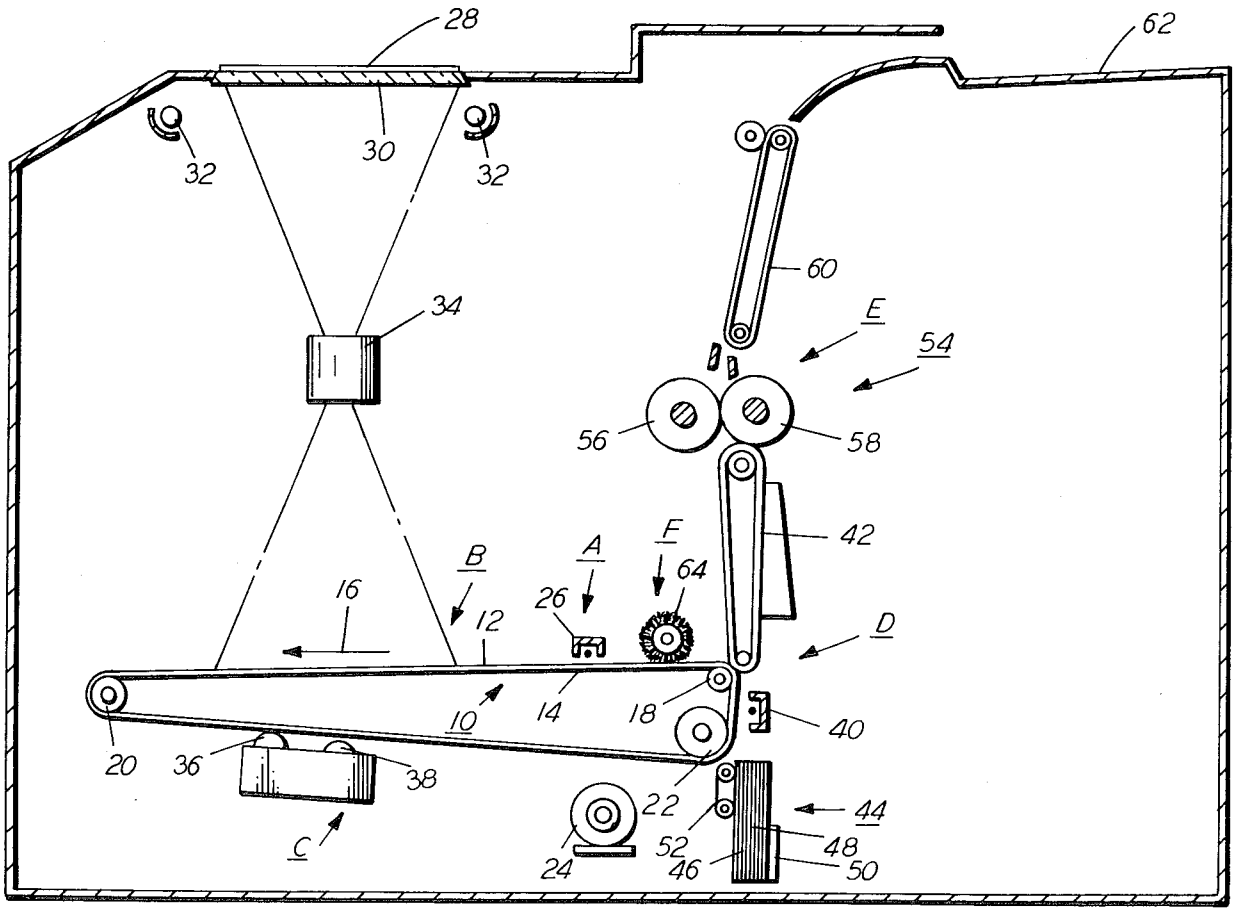
FIG. 1 is a schematic elevational view depicting an electrophotographic printing machine incorporating the features of the present invention therein.
Figure 2:
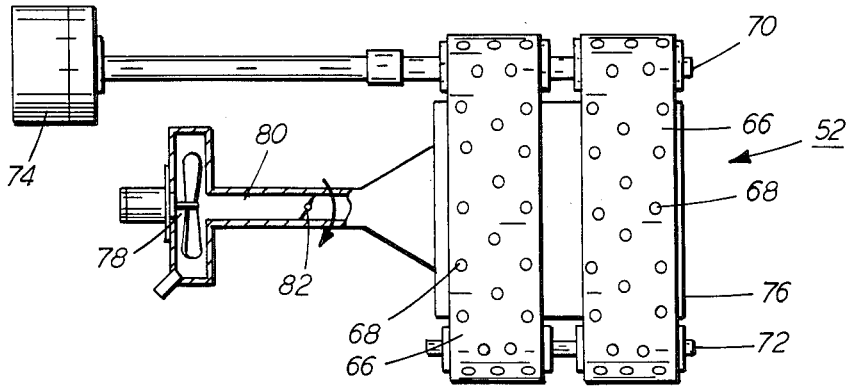
FIG. 2 is an elevational view showing the sheet feeder associated with the sheet feeding and stacking apparatus of the FIG. 1 printing machines.
Figure 6:
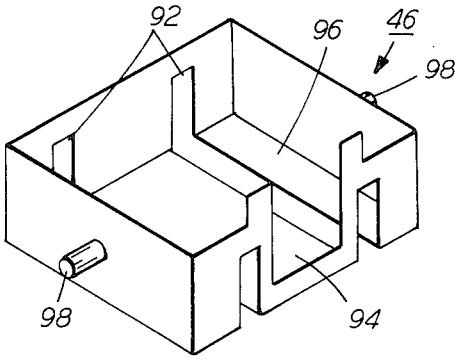
Figure 7:
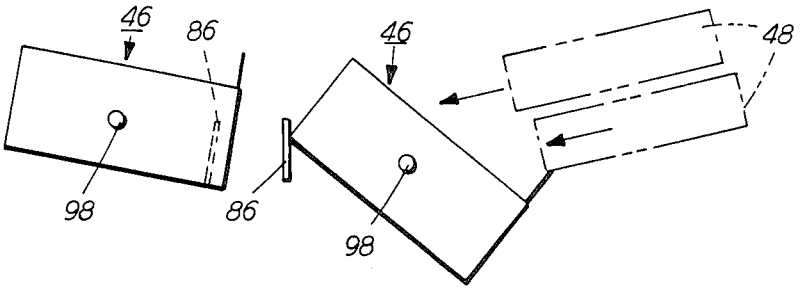

FIG. 6 is a schematic, perspective view illustrating the housing for holding the stack of sheets in the feeder and stacker used in the FIG. 1 printing machine; and FIG. 7 depicts the FIG. 6 housing in an operative position wherein successive outermost sheets are in a feeding relationship with FIG. 2 sheet feeder and in an inoperative relationship wherein a new stack of sheets may be loaded in the FIG. 6 housing.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to identify identical elements. FIG. 1 schematically depicts the various components of an illustrative electrophotographic printing machine incorporating the sheet feeding and stacking apparatus of the present invention therein. The sheet feeding and stacking apparatus of the present invention may be employed for stacking and advancing original documents as well as copy sheets. It will become evident from the following discussion that this apparatus is equally well suited for use in a wide variety of printing machines and is not necessarily limited in its application to the particular printing machine shown herein.

Inasmuch as the art of electrophotographic printing is well known, the various processing stations employed in the FIG. 1 printing machine will be shown hereinafter schematically and their operation described briefly with reference thereto.

As shown in FIG. 1 the electrophotographic printing machine employs a belt 10 having a photoconductive surface 12 deposited on a conductive substrate 14. Preferably, photoconductive surface 12 is made from a selenium alloy with conductive substrate 14 being made from an aluminum alloy. Other suitable photoconductive materials and conductive substrates may also be employed. Belt 10 moves in the direction of arrow 16 to advance successive portions of photoconductive surface 12 sequentially through the various processing stations disposed about the path of movement thereof. Belt 10 is entrained about a stripping roller 18, tensioning roller 20 and drive roller 22. Stripping roller 18 is mounted rotatably so as to rotate with the movement of belt 10. Tensioning roller 20 is resiliently urged against belt 10 to maintain belt 10 under the desired tension. Drive roller 22 is rotated by motor 24 coupled thereto by suitable means such as a drive belt. As roller 22 rotates, it advances belt 10 in the direction of arrow 16.

Initially, a portion of the photoconductive surface passes through charging station A. At charging station A, a corona generating device, indicated generally by the reference numeral 26 charges photoconductive surface 12 to a relatively high, substantially uniform potential.

Next, the charged portion of photoconductive surface 12 is advanced through imaging station B. At imaging station B, an original document 28 is positioned face down on platen 30. Lamps 32 illuminate original document 28 disposed upon platen 30. Light rays reflected from the original document are transmitted through lens 34. Lens 34 focuses the light image of the original document onto the charged portion of the photoconductive surface of belt 10 to selectively dissipate the charge thereon. This records an electrostatic latent image on the photoconductive surface which corresponds to the informational areas contained within the original document. Thereafter, belt 10 advances the electrostatic latent image recorded on the photoconductive surface to development station C.

With continued reference to FIG. 1, at development station C a pair of magnetic brush rollers, indicated generally by the reference numerals 36 and 38, advance developer material into contact with the electrostatic latent image. The latent image attracts toner particles from the carrier granules of the developer material to form a toner powder image on the photoconductive surface of belt 10.

Belt 10 then advances the toner powder image to transfer station D. At transfer station D, a copy sheet is advanced into contact with the powder image. Transfer station D includes corona generating device 40 which sprays ions onto the backside of the copy sheet. This atracts the toner powder image from photoconductive surface 12 of belt 10 to the sheet.

The sheet feeding and stacking apparatus indicated generally by the reference numeral 44, advances successive copy sheets to transfer station D. Sheet feeding and stacking apparatus 44 includes a housing 46 supporting stack of sheets 48 in a substantially vertical orientation. Upright 50 engages one side of the stack of sheets 48 and moves the stack of sheets toward sheet feeder 52. In this way, successive outermost sheets from one side of stack 48 are continously in a feeding relationship with sheet feeder 52 so as to be advanced thereby to transfer station D. After transfer of the toner powder image to the copy sheet, the copy sheet is advanced by conveyor 42 to fusing station E. The detailed structure of sheet feeding and stacking apparatus 44 will be described hereinafter with reference to FIGS. 2 through 7, inclusive.

Fusing station E includes a fuser assembly, indicated generally by the reference numeral 54, which permanently affixes the transferred powder image to the copy sheet. Preferably, fuser assembly 54 includes a heated fuser roller 56 and a back-up roller 58. The sheet passes between fuser roller 56 and back-up roller 58 with the powder image contacting fuser roller 56. In this manner, the powder image is permanently affixed to the copy sheet.

After fusing the toner powder image to the copy sheet, the copy sheets are advanced by conveyor 60 to catch tray 62 for subsequent removal from the printing machine by the operator.

Invariably, after the copy sheet is separated from photoconductive surface 12 of belt 10, some residual particles remain adhering thereto. These residual particles are removed from photoconductive surface 12 at cleaning station F. Cleaning station F includes a rotatably mounted fiberous brush 64 in contact with photoconductive surface 12 of belt 10. The particles are cleaned from photoconductive surface 12 and belt 10 by the rotation of brush 64 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Referring now to the specific subject matter of the present invention, the general operation of the sheet feeding and stacking apparatus will be described hereinafter with references to FIGS. 2 through 7, inclusive.

As shown in FIG. 2, sheet feeder 52 of sheet feeding and stacking apparatus 44 includes a pair of belts 66 having a multiplicity of substantially equally spaced apertures or holes 68 therein. Belts 66 are entrained over spaced support rollers 70 and 72. Roller 70 is coupled to clutch drive 74 which rotates roller 70 so as to advance belts 66. Vacuum plenum 76 is disposed adjacent the underside of belts 66. Blower 78 is coupled to plenum 76 via duct 80. A solenoid actuated valve is positioned in duct 80. When valve 82 is open, air is exhausted by blower 78 from plenum 76. In this way, a copy sheet on one side of stack 48 closely adjacent to belt 66 is attracted thereto. When the clutch is energized, the belts move the copy sheet to transfer station D (FIG. 1). When valve 82 is closed, air is not exhausted from plenum 76 and the copy sheets are not attracted to belt 66. The air exhausted by blower 78 is fed to an air knife which directs a supply of air to the side edges of the stack of sheet. The foregoing is shown more clearly in FIG. 3.

Figure 3:
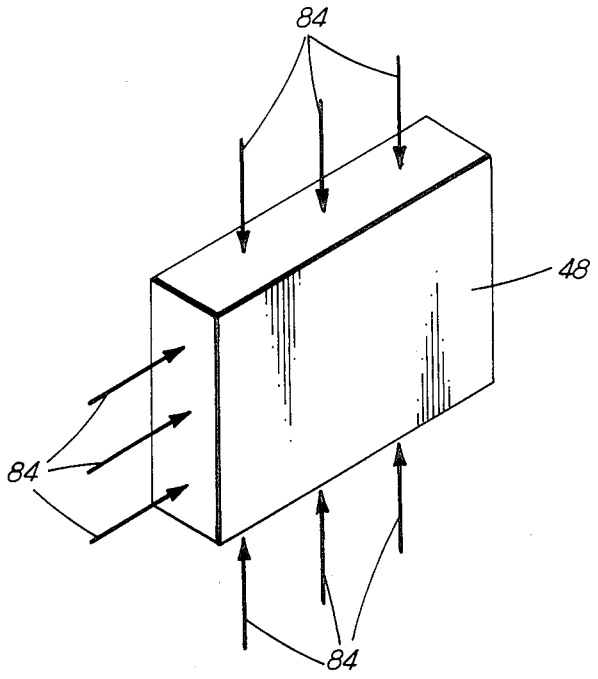
FIG. 3 is a schematic, perspective view showing the flow or air used to separate the sheets of the stack of the sheet feeder and stacker used in the FIG. 1 printing machine.

Referring now to FIG. 3, there is shown stack 48 having air flow directed toward the side edges thereof as indicated by arrows 84. An air knife (not shown) receives the air being exhausted from blower 78 and directs this flow of air toward the side edges of stack 48, as indicated by arrows 84. This facilitates the separation of the outermost copy sheet adjacent sheet feeder 52. In this way, the outermost copy sheet is attracted to belts 66 more readily and does not remain adhering to the remainder of the sheets of stack 48. Stack 48 is moved continuously toward sheet feeder 52. The foregoing is shown more clearly in FIG. 4.

Figure 4:
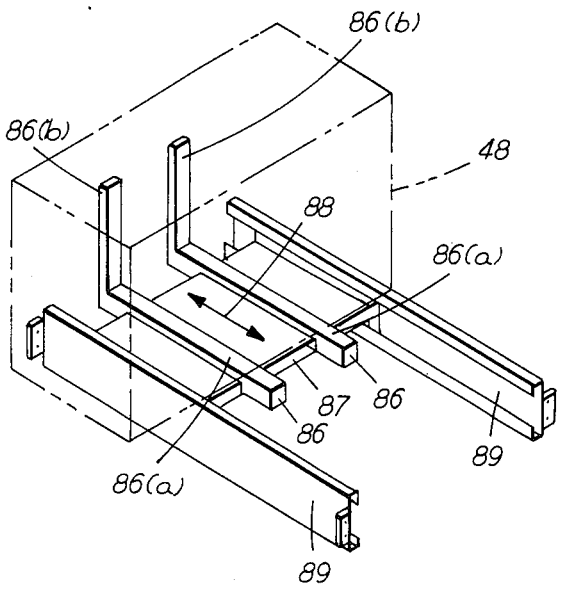
FIG. 4 is a schematic, perspective view showing one embodiment of the support for the stack of sheets in the sheet feeder and stacker used in the FIG. 1 printing machine.
Figure 5:
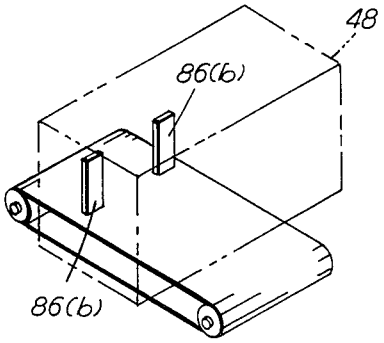
FIG. 5 is a schematic, perspective view illustrating another embodiment of the support for the stack of sheets in the sheet feeder and stacker used in the FIG. 1 printing machine.

Turning now to FIG. 4, there is shown one embodiment of a stack supports 86. Stack supports 86 are substantially L-shaped with one leg 86(*a*) thereof engaging the bottom edge of stack 48 and the other leg 86(*b*) engaging the outermost sheets of stack 48 opposed from sheet feeder 52. Stack supports 86 move toward sheet feeder 52 as indicated by arrow 88 so as to continuously position an outermost sheet of stack 48 adjacent sheet feeder 52. Stack supports 86 are mounted on a plate 87, which in turn, is mounted on slides 89. The slide mechanism minimizes friction and enables the stack supports to move, under the influence of gravity, toward the sheet feeder. One skilled in the art will appreciate that a drive mechanism, e.g. a belt drive or a rack and pinion system, may be utilized in lieu of gravity to move the stack supports toward the sheet feeder.

Turning now to FIG. 4, there is shown another embodiment of the stack support. As shown thereat, legs 86(*b*) are mounted on conveyor 90 and extend in a substantially perpendicular direction thereto, i.e. substantially perpendicular to the planar surface of conveyor 90. Legs 86(*b*) engage the outermost sheet of stack 48 opposed to sheet feeder 52. As conveyor 90 moves in the direction of arrow 88, legs 86(*b*) move in conjunction therewith. In this way legs 86(*b*) move stack 48 toward sheet feeder 52.

Stack 48 is placed in housing 46. Housing 46, as shown in FIG. 6, includes slots 92 for receiving stack supports 86. Opening 94 is positioned to receive belts 66 of sheet feeder 52. Thus, the bottom edge of stack 48 rests on surface 96 of housing 46 with stack supports 86 moving therealong through slots-92. Housing 46 is substantially an open ended box to enable successive stacks of copy sheets to be loaded therein. In loading/and unloading copy sheets from housing 46, housing 46 pivots about rods 98. Thus, housing 46 is mounted pivotably about rods 98 in the frame of sheet feeding and stacking apparatus 44.

With reference to FIG. 7, there is shown housing 46 in the operative position and in the inoperative position for receiving a new stack of copy sheets. As shown in FIG. 7, when stack support 86 reaches a predetermined position, a signal is generated indicating that the copy sheets in copy housing 46 are depleted. Housing 46 is then pivoted about rods 98 so that a new stacks of sheets 48 may be loaded in the open end thereof. In the loading or inoperative position, housing 46 pivots about rods 98 away from stack support 86. In this manner, an additional supply of copy sheets may be readily placed within housing 46. After stacks 48 have been loaded in housing 46, housing 46 pivots about rods 98 in a counter clockwise direction so as to position stacks 48 in a substantially vertical direction. Thus, housing 46 returns to the operative position wherein stack support 86 is in engagement with the side of stack 48 opposed to sheet feeder 52.

It is clear that sheet feeder 52 advances, in seriatim, successive outermost sheets from stack 48 in a direction substantially opposed to the gravitational force exerted on the advancing sheet. Thus, each successive sheet advances in a substantially vertically upward direction opposed to the direction of the gravitational force. The foregoing arrangement has total mechanical movement as opposed to electrical pulses. Moreover, this system reduces the size and complexity of the sheet feeding and stacking system by eliminating any elevator systems while providing a simpler sheet path.

In recapitulation, it is evident that the sheet feeding and stacking apparatus of the present invention supports a stack of sheets in a substantially vertical orientation. Successive outermost sheets are advanced in an upwardly direction opposed to the gravitational force. When additional sheets have to be added to the housing storing the sheets in the sheet feeder, the housing is pivoted to an inoperative position to readily facilitate the loading of a new stack of sheets therein. Thereafter, the housing is pivoted to its operative position wherein the stack of sheets is positioned vertically. Thus, the sheet feeding and stacking apparatus of the present invention significantly reduces the complexity and cost associated with devices hereinbefore employed.

It is, therefore, evident that there has been provided, in accordance with the present invention, an apparatus for stacking and feeding vertically oriented flexible copy sheets used in an electrophotogrpahic printing machine. This apparatus fully satisfies the airs and advantages hereinbefore set forth. While this invention has been described in conjunction with a perferred embodiment thereof, it is evident that many alternatives, modifications, and variations will be apparent to those skilled in the art. Accordingly, it is intended to embrace all such alternatives, modifications, and variations as fall within the spirit and broad scope of the appended claims.

We claim:

1. An electrophotographic printing machine of the type having a toner image formed on a photoconductive belt wherein successive flexible sheets advance to a transfer station for receiving toner images thereat, wherein the improvement includes:

means for holding a stack of sheets in a substantially vertical orientation;

means for feeding successive, outermost sheets from one side of the stack in said holding means in a substantially vertical direction opposed to the direction of the gravitational force exerted thereon;

means, arranged to receive successive sheets from said feeding means, for transporting the sheets to the transfer station for receiving the toner image thereat;

at least one upright member having a planar surface engaging the outermost sheet of the other side of the stack in said holding means; and means for advancing said upright member toward said feeding means to translate the stack with respect to said holding means in a substantially horizontal direction toward said feeding means so as to position successive, outermost sheets of said one side of the stack in said holding means in feeding relationship therewith, said holding means being arranged to move from an operative location in which said advancing means positions the outermost sheet of said one side of the stack in feeding relationship with said feeding means to an inoperative location spaced from said advancing means and said member for loading a new stack of flexible sheets therein.

2. A printing machine according to claim 1, wherein said holding means includes a housing having a slot receiving said upright member therein enabling said upright member to move therealong.

3. A printing machine according to claim 2, wherein said housing has an opening therein adjacent said feeding means to position the outermost sheet of said one side in feeding relationship therewith.

4. A printing machine according to claim 3, wherein said feeding means includes:

an endless belt having at least one generally planar surface moving in a substantially vertical direction; and means for reducing the air pressure between the outermost sheet of said one side of the stack and said belt to attract the sheet to the planar surface of said belt opposed therefrom for movement therewith in a vertical direction.

5. A printing machine according to claim 4, further including means for directing a flow of air toward the edges of the sheets of the stack to facilitate separation of successive outermost sheets of said one side of the stack from the remainder of the sheets in the stack.

* * * * *